United States Patent [19]

Wright

[11] 4,364,451

[45] Dec. 21, 1982

[54] LADDER LOCK

[75] Inventor: Allen C. Wright, Moraga, Calif.

[73] Assignee: Utility Products, Inc., Oakland, Calif.

[21] Appl. No.: 861,220

[22] Filed: Dec. 16, 1977

[51] Int. Cl.[3] ..... E06C 7/06; E06C 1/08

[52] U.S. Cl. ..... 182/213

[58] Field of Search ..... 182/209, 210, 211, 212, 182/213

[56] References Cited

U.S. PATENT DOCUMENTS

| | | | |
|---|---|---|---|
| 856,875 | 6/1907 | Hughes et al. | 182/210 |
| 1,170,395 | 2/1916 | Beatty | 182/210 |
| 2,310,441 | 2/1943 | Klum | 182/213 |

FOREIGN PATENT DOCUMENTS

| | | | |
|---|---|---|---|
| 8021 | of 1892 | United Kingdom | 182/213 |

*Primary Examiner*—Reinaldo P. Machado

*Attorney, Agent, or Firm*—Manfred M. Warren; Robert B. Chickering; Glen R. Grunewald

[57] ABSTRACT

A locking mechanism for a ladder of the extension type having sections slidable over each other where such locking mechanism is affixed to one section and hooks over a rung of the other section to secure the two sections at the desired height, and where such locking mechanism is withdrawable from the plane of the second section during raising or lowering of this section such that it does not bounce and bump against the rungs of the second section during raising or lowering.

5 Claims, 3 Drawing Figures

LADDER LOCK

My invention relates to ladders in general and more particularly to a locking device to be applied to extention ladders that positively lock the ladder sections together when in use.

Locking devices of this type to which the invention relates, in general are attached to the fly section of a ladder and are permanently biased deep between the rungs of the base section. Raising the fly section causes the lock to bounce and bang against the rungs of such base section as it passes while being elevated, such bouncing and banging tending to shorten the life of the lock and in the case of fiber glass ladders causing excessive wear which leads to early need for replacement of rungs.

Among the objects of my invention are:

(1) To provide a novel and improved ladder locking assembly of the type used with extension ladders;

(2) To provide a novel and improved ladder locking assembly of which the locks do not bounce and bang against the rungs during extension or closure;

Additional objects of my invention will be brought out in the following design of a preferred embodiment of the same taken in conjunction with the accompanying drawings, wherein FIG. 1 is a three dimensional view depicting a ladder with the invention installed;

Figure 1:
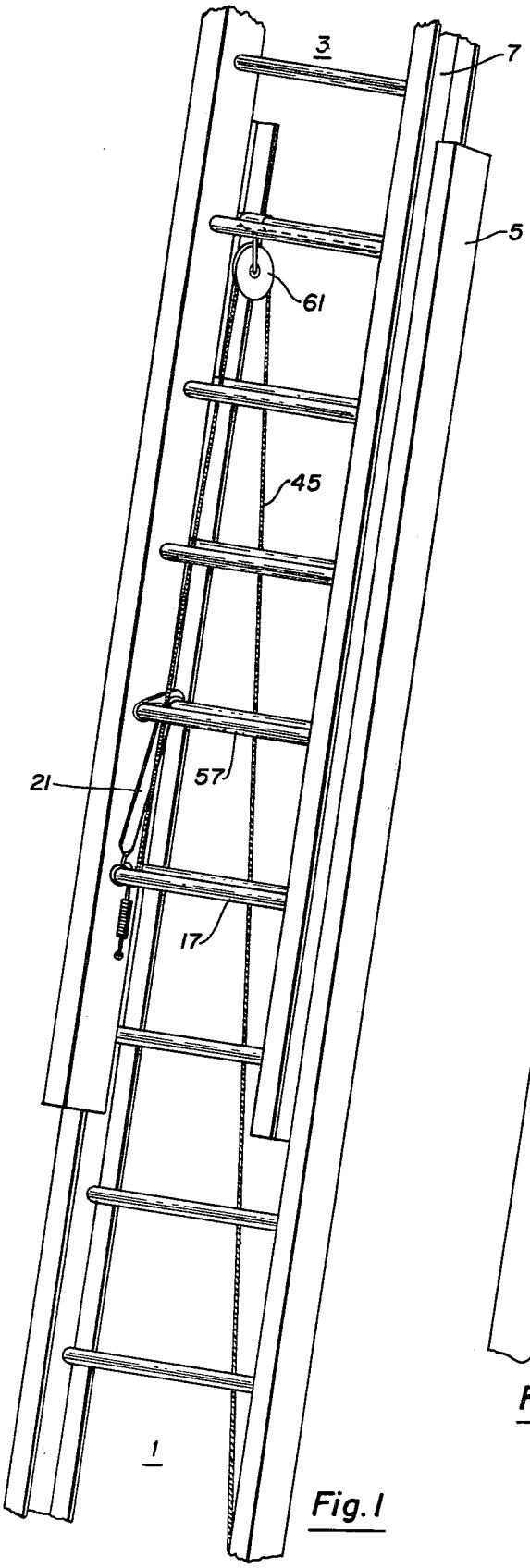
Figure 2:
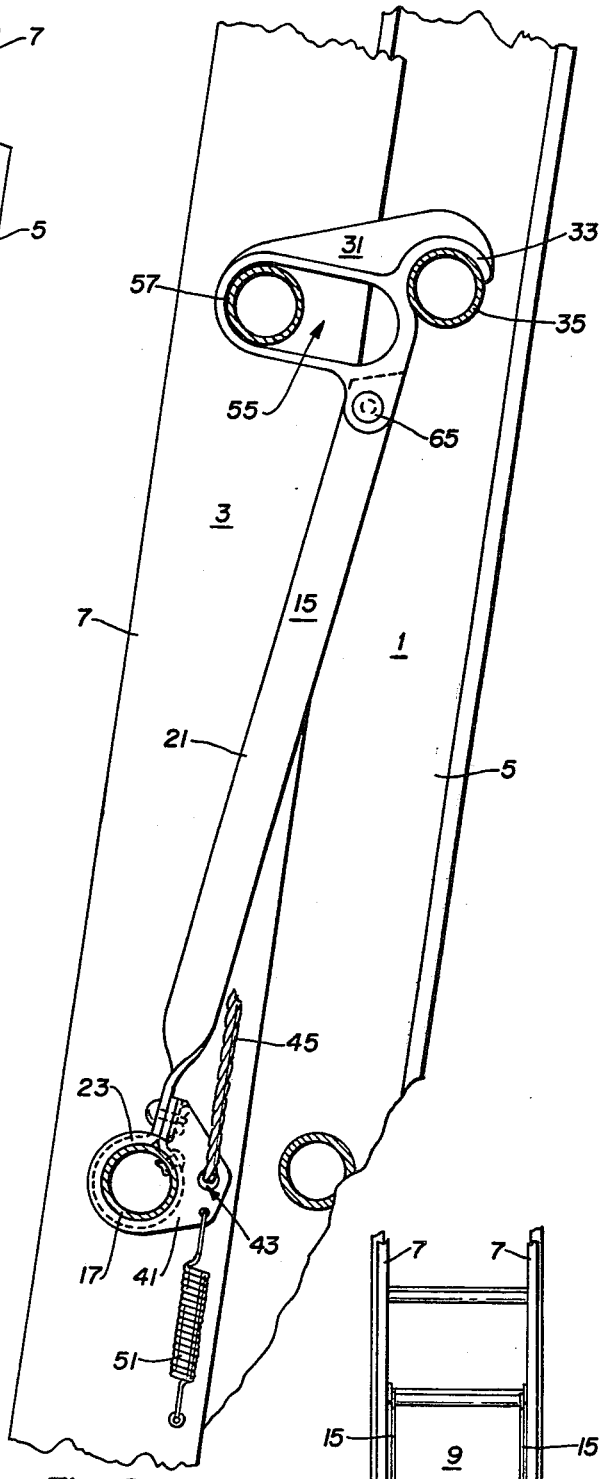
FIG. 2 is a side view in section taken through the ladder of FIG. 1.
Figure 3:
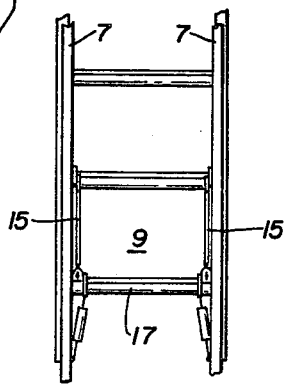
FIG. 3 is a partial front view in elevation showing that portion of a ladder involving the invention.

For details of my invention in its preferred form, reference will be had to accompanying drawings wherein it can be seen that an extension ladder assembly comprises a base ladder section 1 and a fly section 3 each having slidably interlocked U-shaped side rails 5, 7 to maintain alignment during extension and closure.

A lock assembly 9 preferably is comprised of a pair of locks 15 spaced the distance between the rails 7 of the fly section, and fastened to a lower rung 17 thereon, such rung preferably being rotatable. The body of each lock 15 includes a shank 21, the foot 23 of which encircles and fastens to the lower run 17 of the fly ladder section such that the two locks connected thereto complete a unitary assembly 9 where movement of one lock is transferred to the other through the rung.

A head section 31 of the lock on the end opposite the foot, includes a hook 33 adapted to engage a rung 35 of the base ladder section, whereby the two ladder sections have a physical link through the lock to maintain the relative position of one with respect to the other, especially upon application of weight to the fly ladder section, which strengthens such locking engagement.

To directly remove the lock from the plane of the base ladder section, a flange 41 extending from the foot 23 of the shank encircling the rotatable rung 17 has an opening 43 therethrough offset from the axis of the rung in the direction of the base section and is adapted for attachment of a line 45. Upward force on such line elevates the fly section 3 along the base section 1 while simultaneously rotating the lock assembly 9 away from and out of engagement with the base section.

The tension in the line necessary for elevating the fly ladder section is greater than that needed to rotate the lock assembly out of locking engagement, and the lock is therefore maintained out of locking position during elevation because of tension developed during such operation.

Also, the lock assembly, when out of the plane of the base section, is maintained from locking position during closing of the two ladder sections by the constant maintenance of tension on the line as the ladder sections are closed upon another.

Upon termination of extension or closure, less than constant tension on the line allows an extended lock biasing spring 51 connected between the flange and a proximate rail 7 of the fly section in opposition to the line 45, to contract and urge the lock assembly toward engagement position with the base ladder section. Thus, at any extension of the two sections, releasing the line tension will allow the lock assembly to return to the plane of the base ladder section and engage with the nearest proximate rung thereon.

In proximity to the hook 33, the head includes a slotted opening 55 of sufficient size to receive and enable free passage therethrough of a proximate rung 57 of the fly section. The inside perimeter of the slotted opening defines the limits of rotation of the lock assembly 9 about the axis of the lower rung attachment, and maintains such lock assembly in its proximate functional position when the ladder sections are separated as for independent use or for any other reason.

To facilitate providing an upward force on the line 45 at its point of attachment to the flange 41, a pulley 61 is fastened to an upper rung of the base section over which the line is passed, allowing a directional change in the force applied to such line to facilitate a user on the ground operating the ladder.

A hinged connection 65 between the head 31 and shank 15, allowing only limited movement of one upon the other, allows the head to more favorably align itself to mesh with the adjacent rungs on the base section when bringing the lock assembly into locking engagement with the base ladder section.

From the foregoing description of my invention in its preferred form, it will become apparent that the same is subject to alteration and modification without departing from the underlying principles involved, and I do not desire to be limited in my protection to the specific details illustrated and described, except as may be necessitated by the appended claims.

I claim:

1. An extension ladder assembly comprising a base ladder section having side rails, a fly ladder section having side rails slidably mounted on said base ladder section, locking means comprising a shank having a head section and a foot section, said foot section rotatably secured to said fly ladder with said head section including a slotted opening of sufficient size to freely permit passage therethrough of a proximate rung of said fly ladder section for limiting rotation and maintaining said locking means in proximate functional position and with a hook for releasably engaging said base ladder section, secondary means responding to normal ladder use for positively securing said locking means in said engaged position against disengagement from said base ladder section, means directly removing said locking means from locking engagement with said base ladder section to a position spaced from said base ladder section and simultaneously initiating movement of said fly ladder section with respect to said base ladder section while retaining said locking means in said position spaced from said base ladder section, whereby, during movement of said fly ladder section relative to said base ladder section, said locking means will not bounce and bang or otherwise contact against said base ladder section, and when in normal use, application of force on said fly ladder section in a direction of such normal use, strengthens locking engagement between said ladder sections.

2. An extension ladder assembly in accordance with claim 1, characterized by spring means for positively urging said shank and hook toward the plane of said base ladder section.

3. An extension ladder assembly comprising a base ladder section having side rails slidably mounted on said base ladder section, locking means comprising a shank having a head section and a foot section, said foot section rotatably secured to said fly ladder with said head section including a slotted opening of sufficient size to freely permit passage therethrough of a proximate rung of said fly ladder section and with a hook for releasably engaging said base ladder section, means responding to normal ladder use for positively securing said locking means against disengagement from said base ladder section, said positive securing means including a hinged connection between said head and said shank permitting inherent rotational forces on said locking means in a direction to unseat said hook from said base section to pivot said head upon said hinged connection and enable the inside edge of said slotted opening in said head section to come into locking engagement with said surrounded rung, means directly removing said locking said locking means from locking engagement with said base ladder section to a position spaced from said base ladder section and simultaneously initiating movement of said fly ladder section with respect to said base ladder section while retaining said locking means in said position spaced from said base ladder section, whereby, when in normal use, application of force on said fly ladder section in direction of such normal use strengthens locking engagement between said ladder sections.

4. An extension ladder comprising a base ladder section having side rails, a fly ladder section having side rails slidably mounted on said base ladder section, unitary locking means including secondary means positively securing said unitary locking means against disengagement for locking said fly ladder section in a prevailing position upon said base section, said locking means comprising a lock assembly including a pair of spaced locking arms each having a shank with hook at one end for engagement with a rung of said base section and with a foot at the other end rigidly secured to either end of a rotatable rung of said section to provide a unitary assembly with said rotatable rung, a flange proximate the foot of one of said locking arms at one end of said rotatable rung extending toward said base ladder section from which an applied force means may be transferred to the other of said locking arms to rotate said entire unitary locking means into and out of the plane of said base section.

5. An extension ladder assembly comprising a base ladder section having side rails, a fly ladder section having side rails slidably mounted on said base ladder section, unitary locking means for locking said fly ladder section in a prevailing position upon said base section, said locking means comprising a lock assembly including a pair of spaced locking arms each having a shank with head section and a hook at one end for engagement with a rung of said base section and with a foot at the other end rigidly secured to either end of a rotatable rung of said fly section to provide a unitary assembly with said rotatable rung, a flange proximate the foot of one of said locking arms at one end of said rotatable rung extending toward said base ladder section from which an applied force means may be transferred to the other of said locking arms to rotate said entire unitary locking means into and out of the plane of said base section, said head section including a slotted opening of sufficient size to freely permit passage therethrough of a proximate rung of said ladder section and said securing means including a hinged connection between said head and said shank permitting inherent forces on said locking means in a direction to unseat said hook from said base section to pivot said head upon said hinge connection and enable the inside edge of said slotted opening in said head section to come into locking engagement with said surrounded rung.

* * * * *